US012448959B2

(12) United States Patent
Qi et al.

(10) Patent No.: US 12,448,959 B2
(45) Date of Patent: Oct. 21, 2025

(54) OIL SUPPLY DEVICE FOR COMPRESSOR, COMPRESSOR, AND REFRIGERATION EQUIPMENT

(71) Applicants: QINGDAO HAIER REFRIGERATOR CO., LTD, Shandong (CN); HAIER SMART HOME CO., LTD., Shandong (CN)

(72) Inventors: Feifei Qi, Shandong (CN); Jianru Liu, Shandong (CN); Kui Zhang, Shandong (CN); Yiming Wang, Shandong (CN); Hualong Chi, Shandong (CN)

(73) Assignees: QINGDAO HAIRER REFRIGERATOR CO., LTD, Qingdao (CN); HAIER SMART HOME CO., LTD., Qingdao (CN)

( * ) Notice: Subject to any disclaimer, the term of this patent is extended or adjusted under 35 U.S.C. 154(b) by 0 days.

(21) Appl. No.: 18/720,334

(22) PCT Filed: Nov. 15, 2022

(86) PCT No.: PCT/CN2022/131809
§ 371 (c)(1),
(2) Date: Jun. 14, 2024

(87) PCT Pub. No.: WO2023/109401
PCT Pub. Date: Jun. 22, 2023

(65) Prior Publication Data

US 2025/0052236 A1 Feb. 13, 2025

(30) Foreign Application Priority Data

Dec. 17, 2021 (CN) ..... 202111552537.5

(51) Int. Cl.
*F04B 39/02* (2006.01)

(52) U.S. Cl.
CPC ..... *F04B 39/0276* (2013.01); *F04B 39/0284* (2013.01)

(58) Field of Classification Search
CPC ..... F04B 39/0276; F04B 39/0284; F04B 39/123; F04B 39/02
See application file for complete search history.

(56) References Cited

U.S. PATENT DOCUMENTS 6,237,362 B1 5/2001 Jang
6,491,506 B1 * 12/2002 Oh ..... F04B 35/045 417/406

(Continued)

FOREIGN PATENT DOCUMENTS

CN 1995751 A 7/2007
CN 103775309 A 5/2014

(Continued)

*Primary Examiner* — Michael A Riegelman
(74) *Attorney, Agent, or Firm* — MUNCY, GEISSLER, OLDS & LOWE, P.C.

(57) ABSTRACT

The present application discloses an oil supply device of a compressor, a compressor and a refrigeration equipment, the oil supply device of a compressor comprising: a piston cylinder with an inner chamber, a piston, an outer housing, and an oil intake passage and an oil discharge passage, the oil intake passage comprises an oil intake chamber, an oil inlet and an oil outlet; the side wall of the oil intake chamber has an arcuate flow guide portion to direct flow between the oil inlet and the oil outlet. The application can create a vortex in the oil intake chamber after the oil entering the oil intake chamber from the oil inlet, thereby improving the oil suction efficiency.

15 Claims, 10 Drawing Sheets

(56) References Cited

U.S. PATENT DOCUMENTS

| | | | | |
|---|---|---|---|---|
| 8,556,599 | B2 * | 10/2013 | Lee | F04B 39/0238 184/32 |
| 9,726,164 | B2 * | 8/2017 | Kang | F04B 39/14 |
| 11,193,700 | B2 * | 12/2021 | Noh | F04B 39/125 |
| 2004/0104076 | A1 * | 6/2004 | Heo | F04B 39/0292 184/6.16 |
| 2008/0008609 | A1 * | 1/2008 | Pate | F04C 13/001 417/415 |
| 2008/0063549 | A1 * | 3/2008 | Biscaldi | F04B 35/045 417/451 |
| 2010/0296951 | A1 * | 11/2010 | Lee | F04B 39/023 417/417 |
| 2021/0095652 | A1 * | 4/2021 | Hahn | F04B 39/023 |
| 2025/0052235 | A1 * | 2/2025 | Qi | F25B 31/002 |
| 2025/0052236 | A1 * | 2/2025 | Qi | F04B 39/123 |

FOREIGN PATENT DOCUMENTS

| | | | | | |
|---|---|---|---|---|---|
| CN | 203816491 | U | | 9/2014 | |
| CN | 103147959 | B | * | 9/2015 | |
| CN | 204827863 | U | | 12/2015 | |
| CN | 106321407 | A | | 1/2017 | |
| CN | 206972546 | U | | 2/2018 | |
| CN | 108368819 | A | | 8/2018 | |
| CN | 110529364 | A | | 12/2019 | |
| CN | 211009018 | U | | 7/2020 | |
| CN | 217029230 | U | | 7/2022 | |
| CN | 114909272 | A | * | 8/2022 | F04B 39/00 |
| CN | 217652883 | U | | 10/2022 | |
| KR | 19990057581 | A | | 7/1999 | |

* cited by examiner

OIL SUPPLY DEVICE FOR COMPRESSOR, COMPRESSOR, AND REFRIGERATION EQUIPMENT

The present application is a national phase entry of International Application No. PCT/CN2022/131809, filed Nov. 15, 2022, which claims priority to Chinese Patent Application No. CN202111552537.5, filed Dec. 17, 2021, which are incorporated herein by reference in their entirety.

TECHNICAL FIELD

Present application relates to the technical field of compressors, specifically to an oil supply device for compressor, compressor, and refrigeration equipment.

BACKGROUND

Traditional refrigeration compressors utilize a rotary electric motor to convert rotary motion into linear motion of a piston in a compressor cylinder through a crank linkage structure, thereby compressing the refrigerant during the piston's linear movement. Due to the complexity of manufacturing various components and the friction between them, the efficiency of the compressor is reduced, resulting in high power consumption.

Linear compressors use permanent magnets and coils to form linear motors or linear movements to replace crank linkage mechanisms and rotary motors, reducing the number of transmission components and thereby reducing friction between components. To further reduce energy loss caused by friction, it is necessary to supply lubricating oil to friction parts between relatively moving components, i.e., to supply lubricating oil to the compressor piston cylinder. In linear compressors, in order to supply oil to the driving piston and other friction parts, the vibration energy of the machine body is typically used to drive the oil supply device for compressor to supply oil between the compressor piston cylinder and the driving piston.

As shown in FIG. 18, the oil supply device for a compressor is generally provided in the compressor chamber of the compressor housing 100, and is provided on a core assembly within the compressor chamber. The specific core assembly includes a compressor piston cylinder 200, a driving piston that moves within the compressor piston cylinder 200, and an elastic support part 300. The oil supply device for a compressor 400 is fixed on the compressor piston cylinder 200, which is fixed within the compressor housing 100 by the elastic support part 300. The energy generated by the elastic support part 300 during vibration drives the piston within the oil supply device for a compressor 400, the piston realizes the suction and discharge of the oil supply device for a compressor 400 during its activity, thereby realizing the oil supply to the compressor piston cylinder 200.

The oil supply device for a compressor generally has the oil suction port facing downward, drawing lubricating oil located below the oil supply device into the oil storage space through a vertically extending pipeline, and then discharging it into the driving piston cylinder through an oil discharge hole. Since the lubricating oil needs to overcome its own gravity to move upwards vertically, the existing oil supply devices for a compressor cannot efficiently draw oil.

Reference to any prior art in the specification is not, and should not be taken as, an acknowledgment or any form of suggestion that this prior art forms part of the common general knowledge in Europe or any other jurisdiction or that this prior art could reasonably be expected to be understood and regarded as relevant by a person skilled in the art.

SUMMARY

The objective of the present application is to provide an oil supply device for a compressor to solve the deficiencies of existing technology. It can create a vortex in the oil intake chamber after the oil entering the oil intake chamber from the oil inlet, thereby accelerating the lubricating oil's entry into the inner chamber from the oil outlet, and forming a stronger adsorption capacity at the oil inlet, thereby improving oil suction efficiency.

The present application provide an oil supply device for a compressor, comprising: a piston cylinder with an inner chamber, a piston slidingly disposed in the inner chamber, an outer housing cooperating with the piston cylinder, and an oil intake passage and an oil discharge passage provided on the outer housing;

the oil intake passage comprises an oil intake chamber extending horizontally, an oil inlet set on a side wall of the oil intake chamber, and an oil outlet set on a bottom wall of the oil intake chamber that communicates with the inner chamber;

the side wall of the oil intake chamber has an arcuate flow guide portion to direct flow between the oil inlet and the oil outlet.

Further, the oil inlet is located at the bottom of the side wall of the oil intake chamber, and the oil inlet and the oil outlet are misaligned with each other in a lateral direction.

Further, one end of the arcuate flow guide portion extends to the oil inlet, the other end of the arcuate flow guide portion extends above the oil outlet, and the arcuate flow guide portion bends in a direction away from the oil outlet.

Further, the shape of the arcuate flow guide portion conforms to an Archimedean spiral.

Further, the opening direction of the oil outlet is parallel to the sliding direction of the piston.

Further, the oil discharge passage comprises an oil discharge chamber which arranged parallel to the oil intake chamber in a lateral direction, an oil discharge outlet on a side wall of the oil discharge chamber and an oil discharge inlet on a bottom wall of the oil discharge chamber, the oil discharge inlet communicates with the inner chamber, and the oil discharge outlet is located at the top of the oil discharge chamber.

Further, the oil discharge outlet is positioned opposite to the oil inlet in the vertical direction.

Further, the outer housing also has an oil discharge hole communicating with the oil discharge outlet and an oil intake hole communicating with the oil inlet, the outlet of the oil discharge hole is positioned opposite to the inlet of the oil intake hole, the outlet of the oil discharge hole and the inlet of the oil intake hole are respectively located on the top and bottom surfaces of the outer housing; and the inlet of the oil intake hole is located at the lowest point d of the bottom surface D of the outer housing.

Further, the oil discharge chamber and the oil intake chamber are separated by a partition plate, the arcuate flow guide portion located at a side of the partition plate facing the oil intake chamber.

Further, the outer housing comprises a housing body with a housing groove and a separation board located in the housing groove and parallel to the bottom of the housing groove, and the separation board separates the housing groove into an oil chamber and an external chamber, the partition plate is disposed in the oil chamber and separates the oil chamber into the oil discharge chamber and the oil intake chamber, the oil discharge inlet and the oil outlet are arranged side by side on the separation board.

Further, the partition plate is fixed to the separation board and forms a separator with the separation board, the separator is positioned in the housing groove, and the partition plate is abut against the bottom plate of the housing groove.

Further, the partition plate has a partition portion located between the oil intake chamber and the oil discharge chamber, a first enclosing plate and a second enclosing plate are set at both ends of the partition portion, the first enclosing plate and the second enclosing plate are integrally formed with the partition portion; the first enclosing plate and the second enclosing plate form an S-shape with the partition portion, and both the first enclosing plate and the second enclosing plate are abut against the bottom of the housing groove.

Further, both the first enclosing plate and the second enclosing plate are extended and arranged at an edge of the separation board, the free end of the first enclosing plate and the partition portion form the oil inlet, the free end of the second enclosing plate and the partition portion form the oil discharge outlet.

Further, the bottom wall of the piston cylinder has a piston cylinder oil inlet and a piston cylinder oil outlet, the piston cylinder oil inlet is positioned opposite to the oil outlet, and the piston cylinder oil outlet is positioned opposite to the oil discharge inlet; the outer housing has a housing groove, the partition plate is located in the housing groove, one end of the piston cylinder extends into the housing groove and fixes the separator against the bottom of the housing groove.

Further, the oil supply device for a compressor further comprising an oil valve located between the piston cylinder and the separation board, the oil valve comprises a valve seat frame, an oil intake valve plate and an oil discharge valve plate, the oil intake valve plate and the oil discharge valve plate are fixed to the valve seat frame by elastic connection plates;

and the piston cylinder has an oil intake avoidance space opposite to the oil intake valve plate, the separation board has an oil intake limiting portion for abutting against the oil intake valve plate, the oil intake valve plate blocks the oil outlet in the initial state;

and the piston cylinder has an oil discharge limiting portion for abutting against the oil discharge valve plate, the separation board has an oil discharge avoidance space opposite to the oil discharge valve plate, the oil discharge valve plate blocks the piston cylinder oil outlet in the initial state.

Further, the size of the piston cylinder oil inlet is larger than that of the oil intake valve plate, the piston cylinder oil inlet forming the oil intake avoidance space;

the size of the oil discharge inlet is larger than that of the oil discharge valve plate, the oil discharge inlet forming the oil discharge avoidance space.

Further, the size of the oil inlet is smaller than that of the oil intake valve plate, the oil intake limiting portion is arranged on the separation board and located at the edge of the oil inlet;

the size of the piston cylinder oil outlet is smaller than that of the oil discharge valve plate, with the oil discharge limiting portion is arranged on the piston cylinder and located at the edge of the piston cylinder oil outlet.

Another embodiment of the present application also discloses a compressor, comprising a compressor housing with a compression chamber, a core assembly located in the compression chamber, and the oil supply device for a compressor, the core assembly is fixed to the compressor housing by an elastic support part, the oil supply device for a compressor is fixed to the core assembly, the core assembly being provided with a compressor piston cylinder and a driving piston that movable in the compressor piston cylinder, the oil discharge passage communicates with the compressor piston cylinder, and the oil intake passage communicates with the compression chamber.

Another embodiment of the present application also discloses a refrigeration equipment, comprising a cabinet and a refrigeration system installed on the cabinet, wherein the refrigeration system comprises the compressor.

Compared with the prior art, the present application sets the oil intake chamber to extend horizontally, with an oil inlet formed on the side wall of the oil intake chamber and an oil outlet formed on the bottom wall of the oil intake chamber, an arcuate flow guide portion is arranged between the oil inlet and the oil outlet. It can create a vortex in the oil intake chamber after the oil entering the oil intake chamber from the oil inlet, thereby accelerating the lubricating oil's entry into the inner chamber from the oil outlet, and forming a stronger adsorption capacity at the oil inlet, thereby improving oil suction efficiency.

As used herein, except where the context clearly requires otherwise, the term "comprise" and variations of the term, such as "comprising", "comprises" and "comprised", are not intended to exclude further features, components, integers or steps.

Figure 1:
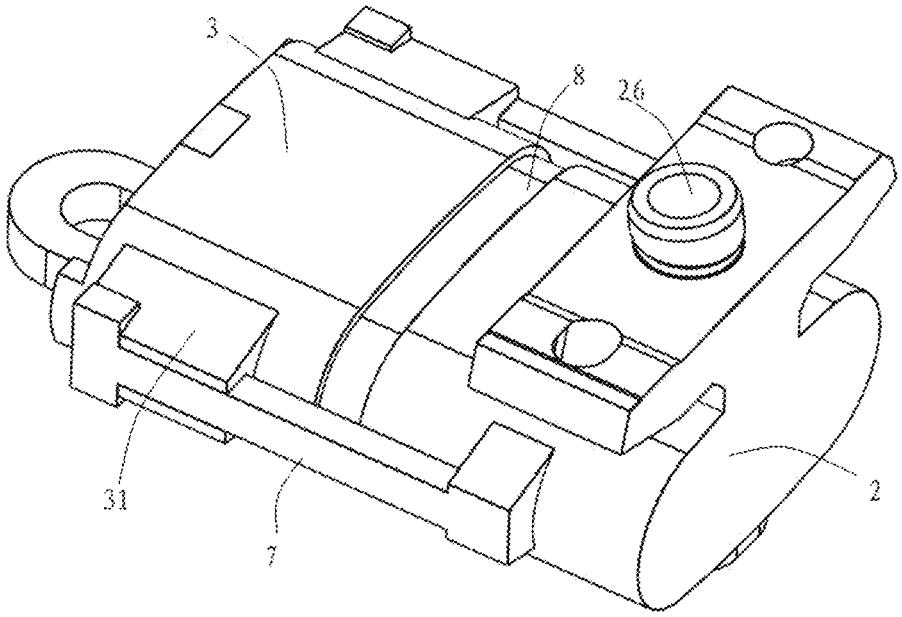
FIG. 1 is a first schematic structural diagram of the oil supply device for a compressor disclosed in an embodiment of the present application.
Figure 2:
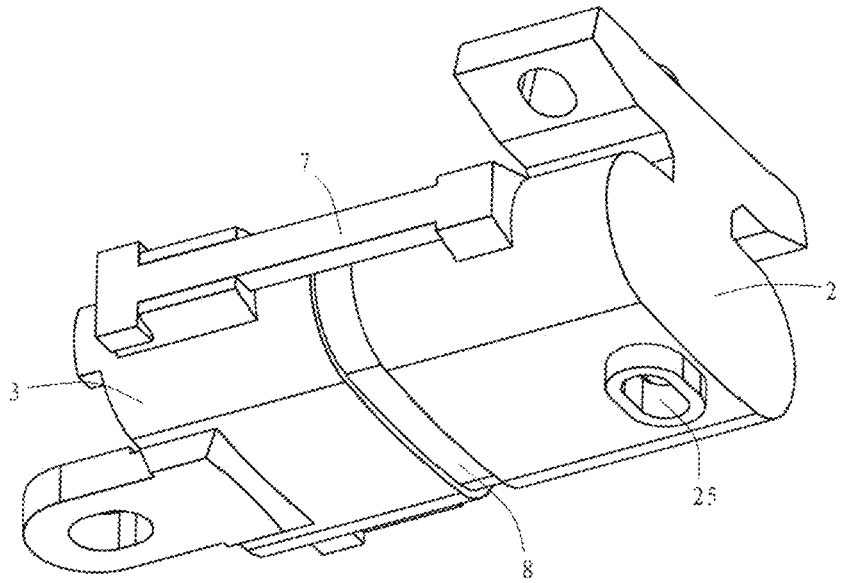
FIG. 2 is a second schematic structural diagram of the oil supply device for a compressor disclosed in the embodiment of the present application.

Description of Symbols: 1—piston cylinder, C—inner chamber, 11—cylinder body, 110—piston chamber, 12—cylinder cover, 120—oil passage groove, 121—piston body limiting part, 13—piston cylinder oil inlet, 14—piston cylinder oil outlet, 15—bottom wall limiting part, F2—the sliding direction of the piston,

2—outer housing, 20—housing groove, 21—oil intake chamber, 211—oil inlet, 212—oil outlet; 213—arcuate flow guide portion, 214—a side wall of the oil intake chamber, 215—a bottom wall of the oil intake chamber, 22—oil discharge chamber, 221—oil discharge inlet, 222—oil discharge outlet, 223—a side wall of the oil discharge chamber, 224—a bottom wall of the oil discharge chamber, 225—the top of the oil discharge chamber, 23—housing body, 24—separator, 241—separation board, 242—partition plate, 243—first enclosing plate, 244—second enclosing plate, 25—oil intake hole, 26—oil discharge hole, P—oil intake passage, L—oil discharge passage, F1—a lateral direction, F3—a vertical direction, T—the top surface of the outer housing, D—the bottom surface of the outer housing, d—the lowest point of the bottom surface of the outer housing,

3—housing base, 30—base groove, 31—positioning protrusion, 32—positioning slot, 33—axial limiting part,

4—piston, 41—piston body, 42—fixing post, 43—counterweight,

5—flat plate shrapnel, 51—frame, 52—elastic piece, 53—installation part, 54—yielding space,

6—oil valve, 61—valve seat frame, 62—oil intake valve plate, 63—oil discharge valve plate, 64—elastic connecting piece,

7—tensioning member, 71—connecting rod, 72—limiting rod,

8—gap part, 9—gasket,

100—compressor housing, 200—compressor piston cylinder, 300—elastic support part, 400—compressor, 500—refrigeration equipment, 600—refrigeration system.

DETAILED DESCRIPTION OF EMBODIMENTS

The embodiments described below with reference to the accompanying drawings are exemplary and are only intended to explain the present invention, and should not be construed as limiting the present application.

As shown in FIGS. 1-18, Embodiment of the present application: An oil supply device for a compressor is disclosed, wherein the oil supply device for a compressor is used to add lubricating oil to a driving piston cylinder of a linear compressor.

Specifically, as shown in FIGS. 1-4, the oil supply device for a compressor in this embodiment includes: a housing and a piston 4 arranged within the housing, the housing includes a piston cylinder 1 with an inner chamber C, an outer housing 2 cooperating with the piston cylinder 1, and a housing base 3 cooperating with the piston cylinder 1. The piston 4 is slidably arranged within the inner chamber C. The axial direction of the piston cylinder 1 extends horizontally, and it has an oppositely arranged bottom wall and side walls. The piston 4 is slidably arranged within the piston cylinder 1 along the horizontal direction.

The outer housing 2 is provided with an oil intake passage P and an oil discharge passage L which are communicating with the inner chamber C. When the piston 4 slides within the inner chamber C, it draws oil into the inner chamber C through the oil intake passage P and expels oil through the oil discharge passage L. In this embodiment, the oil intake passage P communicates with the inner chamber C of the compressor housing 100 and is used to draw lubricating oil from the compressor housing 100, while the oil discharge passage L communicates with the compressor piston cylinder 200 to drive the piston to slide inside the compressor piston cylinder 200 to control the compression of the refrigerant.

Figure 3:
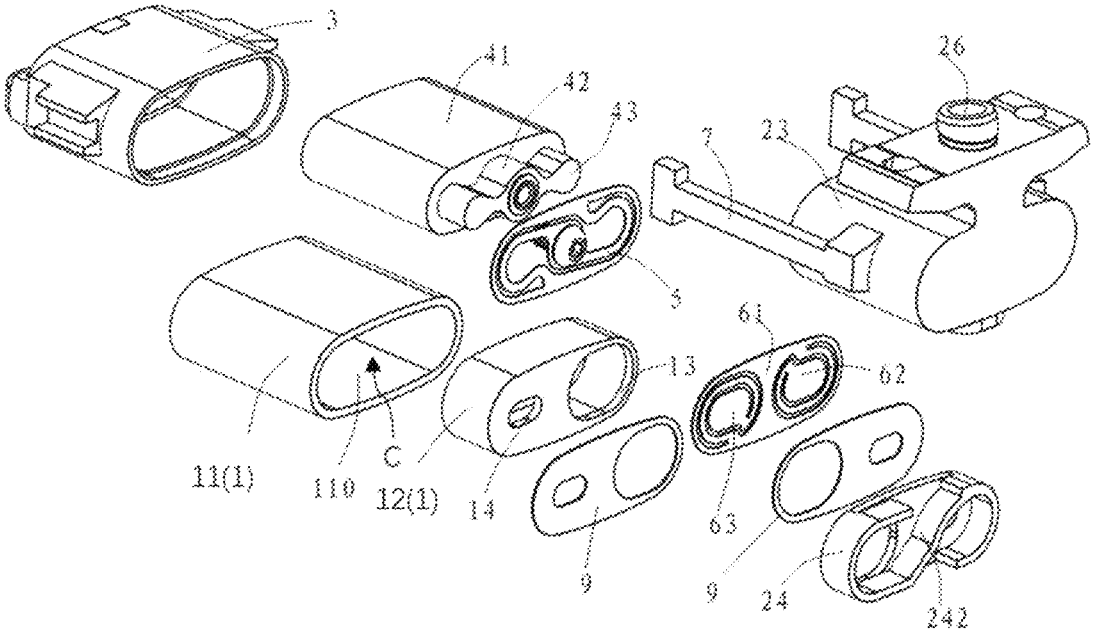
FIG. 3 is a decomposition diagram of the oil supply device for a compressor disclosed in the embodiment of the present application.
Figure 12:
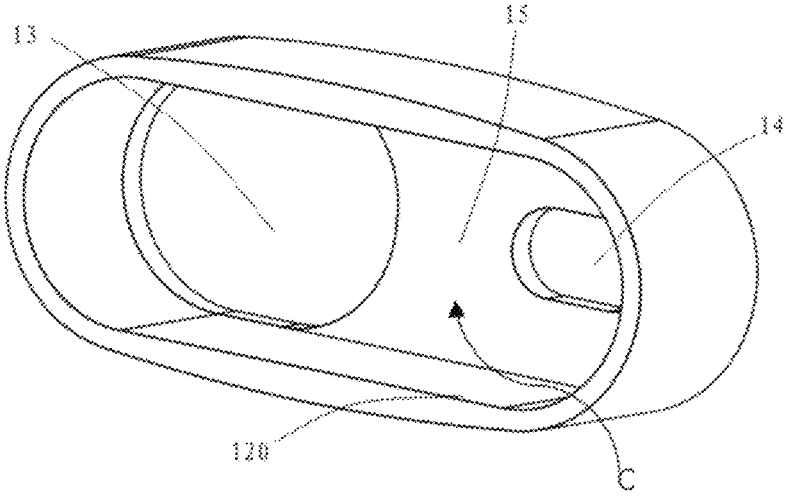
FIG. 12 is a first schematic structural diagram of a cylinder cover of the oil supply device for a compressor disclosed in the embodiment of the present application.

To facilitate the installation and fixation of the piston 4 within the inner chamber C of the oil supply device for a compressor, as shown in FIG. 3, the piston cylinder 1 includes a cylinder body 11 with a piston chamber 110 and a cylinder cover 12 arranged beside the cylinder body 11. The cylinder cover 12 cooperates with the cylinder body 11. The piston 4 moves within the piston chamber 110. the piston chamber 110 is exposed from both the top and bottom sides of the cylinder body 11 and completely penetrates the top and bottom walls of the cylinder body 11. As shown in FIG. 12, the cylinder cover 12 is provided with an oil passage groove 120 exposed to the piston chamber 110, the piston chamber 110 communicates with the oil passage groove 120, and forming the inner chamber C.

The piston 4 slides within the piston chamber 110, forming an oil storage space between the piston 4 and the bottom of the oil passage groove 120. The oil storage space is used to store the lubricating oil drawn into the inner chamber C, The oil storage space changes with the dimension of the active space of the piston 4. The sliding process of the piston 4 changes the air pressure within the oil storage space.

When the piston 4 moves away from the cylinder cover 12, the volume of the oil storage space increases, reducing the air pressure within the oil storage space, oil enters the oil storage space through the oil intake passage P;

When the piston 4 moves closer to the cylinder cover 12, the volume of the oil storage space decreases, compressing the air within the oil storage space, increasing the air pressure, and oil is expelled from the oil storage space through the oil discharge passage L.

Figure 13:
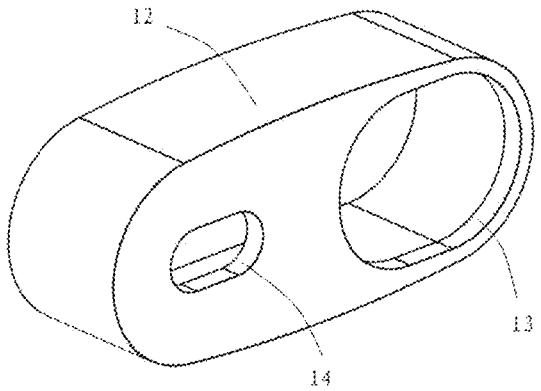
FIG. 13 is a second schematic structural diagram of the cylinder cover of the oil supply device for a compressor disclosed in the embodiment of the present application.

It is understood that, as shown in FIGS. 12 and 13, the cylinder cover 12 is provided with a piston cylinder oil inlet 13 and a piston cylinder oil outlet 14 which are communicated with the inner chamber C. The piston cylinder oil inlet 13 and the piston cylinder oil outlet 14 are provided with openings along the axial direction of the piston cylinder 1, that is, the opening directions of the piston cylinder oil inlet 13 and the piston cylinder oil outlet 14 are parallel to the sliding direction F2 of the piston 4. It is understood that, the piston cylinder oil inlet 13 communicates with the oil intake passage P, and the piston cylinder oil outlet 14 communicates with the oil discharge passage L.

The piston cylinder oil inlet 13 and the piston cylinder oil outlet 14 are both arranged on the bottom wall of the cylinder cover 12 and penetrate through the bottom wall of the cylinder cover 12. The piston cylinder oil inlet 13 and the piston cylinder oil outlet 14 are located at the bottom of the oil passage groove 120. By setting the piston cylinder oil inlet 13 and the piston cylinder oil outlet 14 along the axial direction of the piston cylinder 1, the direction of oil entering and exiting the oil storage space is consistent with the movement direction of the piston 4, which enables the oil to enter and exit the oil storage space more smoothly and efficiently in the process of sliding of the piston 4, thereby better realizing the oil supply of the oil supply device for a compressor.

The piston cylinder oil inlet 13 and the piston cylinder oil outlet 14 are arranged side by side in the horizontal direction. This configuration allows for more efficient oil flow into and out of the oil passage groove 120, and being side by side in the horizontal direction not only facilitates oil intake but also prevents oil from remaining in the oil storage space. In specific embodiments, the piston cylinder oil inlet 13 and the piston cylinder oil outlet 14 are arranged side by side 1 along a lateral direction F1, which the lateral direction F1 in this embodiment is the horizontal direction and perpendicular to the sliding direction F2 of the piston 4.

Of course, in another embodiment, the piston cylinder oil inlet 13 and the piston cylinder oil outlet 14 can also be arranged on the side wall of the cylinder cover 12 (not shown in the figure). The piston cylinder oil inlet 13 and the piston cylinder oil outlet 14 can be arranged side by side on the same side wall of the cylinder cover 12 or on opposite sides of the cylinder cover 12. However, arranging them on the side wall of the cylinder cover 12 is less efficient for oil entry and exit compared to arranging them on the bottom wall of the cylinder cover 12.

Figure 10:
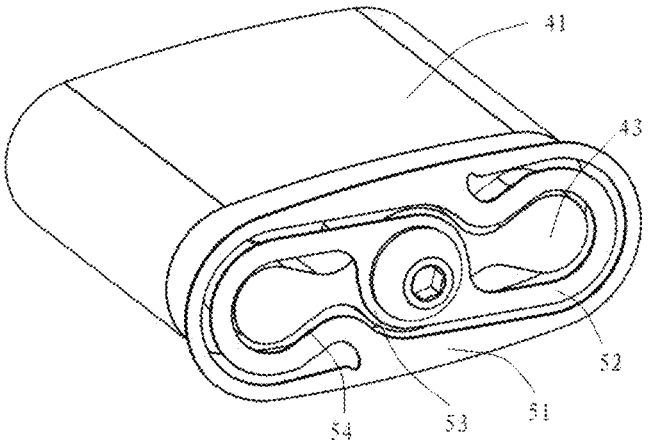
FIG. 10 is a schematic structural diagram of the installation structure of a piston and a flat plate shrapnel of the oil supply device for a compressor disclosed in the embodiment of the present application.
Figure 11:
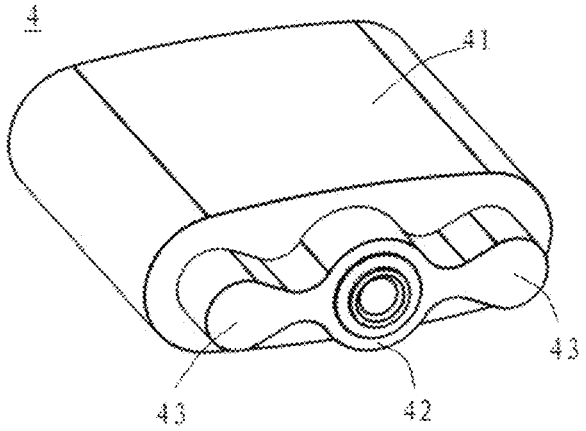
FIG. 11 is a schematic structural diagram of the piston of the oil supply device for a compressor disclosed in the embodiment of the present application.

In this embodiment, as shown in FIGS. 10-11, the cross-section of the piston 4 is elliptical, and the long axis of the elliptical extends in the lateral direction F1, that is, the dimension of the piston 4 in a vertical direction F3 is smaller than its dimension in the horizontal direction, so that the piston 4 as a whole is in the form of a flat shape. This configuration reduces the dimension of the piston 4 in the vertical direction F3, preventing excessive occupation of vertical space, thereby facilitating the installation and fixation of the piston 4 and effectively utilizing the space in the lateral direction F1.

During the actual installation process, the oil supply device of a compressor 400 is generally fixed between the compressor housing 100 and the compressor piston cylinder 200, with the oil supply device of a compressor 400 arranged below the compressor piston cylinder 200. However, the space below the compressor piston cylinder 200 is usually limited and relatively narrow. If the oil supply device of a compressor 400 has a large vertical dimension, it is not conducive to the installation and manufacturing of the compressor.

In this embodiment, the flat structure of the piston 4 effectively reduces the space occupied by the oil supply device of a compressor 400 in the vertical direction F3. At the same time, transferring the volume of the piston 4 from the vertical direction F3 to the lateral direction F1, reduces the height in the vertical direction F3 without reducing the weight of the piston 4. This allows the piston 4 to maintain continuous sliding within the piston cylinder 1 under the action of inertia.

Further, since the piston 4 slides within the piston cylinder 1, to prevent wear caused by the long-term sliding fit between the piston 4 and the piston cylinder 1, the material of the piston cylinder 1 is metal. In a specific embodiment, the material of the cylinder body 11 is metal, and the piston 4 primarily slides within the cylinder body 11. The material of the cylinder cover 12 is preferably plastic, the advantage of setting the cylinder cover 12 into plastic is that it is easier to manufacture.

During actual use, the sliding motion of the piston 4 within the piston cylinder 1 is synchronized with the oscillation of the compressor piston cylinder 200. The compressor piston cylinder 200 is generally fixed to the compressor housing 100 by an elastic support part 300, and swings within the compression chamber of the compressor housing 100. When the compressor piston cylinder 200 oscillates, it drives the piston 4 to oscillate within the piston cylinder 1. In this embodiment, to maintain the stability and continuity of the piston 4 during oscillation, the oil supply device of a compressor 400 also includes a sliding elastic member. The sliding elastic member is used to provide a relatively stable driving force during the sliding process of the piston 4.

The sliding elastic member can convert the kinetic energy of the sliding piston 4 into stored elastic potential energy through its deformation, and when the motion of the piston 4 stops and its kinetic energy is zero, the elastic potential energy stored by the sliding elastic member can convert into kinetic energy once again, to drive the piston 4 move in the opposite direction.

The sliding elastic member can be a spring, wherein the spring is compressed when the piston 4 slides toward the spring, the spring stores energy. The stored energy of the spring can push the piston 4 to move in the opposite direction, thereby maintaining the oscillation of the piston 4 within the piston cylinder 1.

Figure 17:
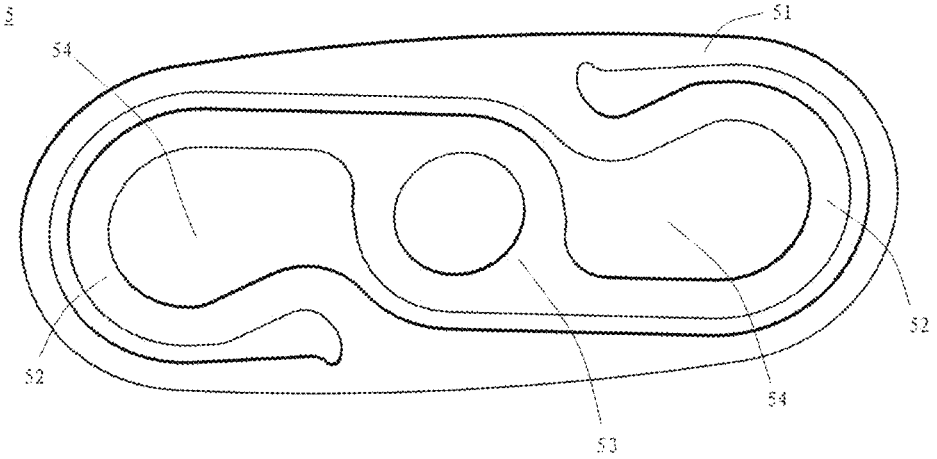
FIG. 17 is a schematic structural diagram of the flat plate shrapnel of the oil supply device for a compressor disclosed in the embodiment of the present application.
Figure 18:
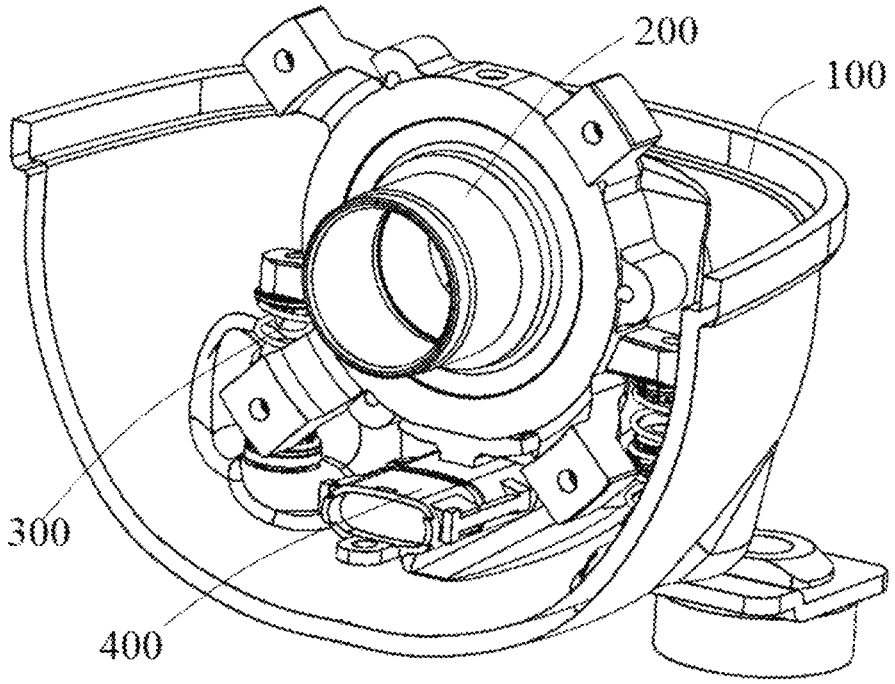
FIG. 18 is a schematic structural diagram of a mounting structure of the oil supply device for a compressor disclosed in the embodiment of the present application on a compressor housing.

As a preferred embodiment, as shown in FIGS. 10 and 17, the sliding elastic member is a flat plate shrapnel 5. The flat plate shrapnel 5 is plate-shaped or sheet-shaped, The flat plate shrapnel 5 includes a frame 51 fixed relative to the housing, an elastic piece 52 connected to the inner side of the frame 51, and an installation part 53 provided on the elastic piece 52. The installation part 53 is fixedly connected to the piston 4.

Figure 4:
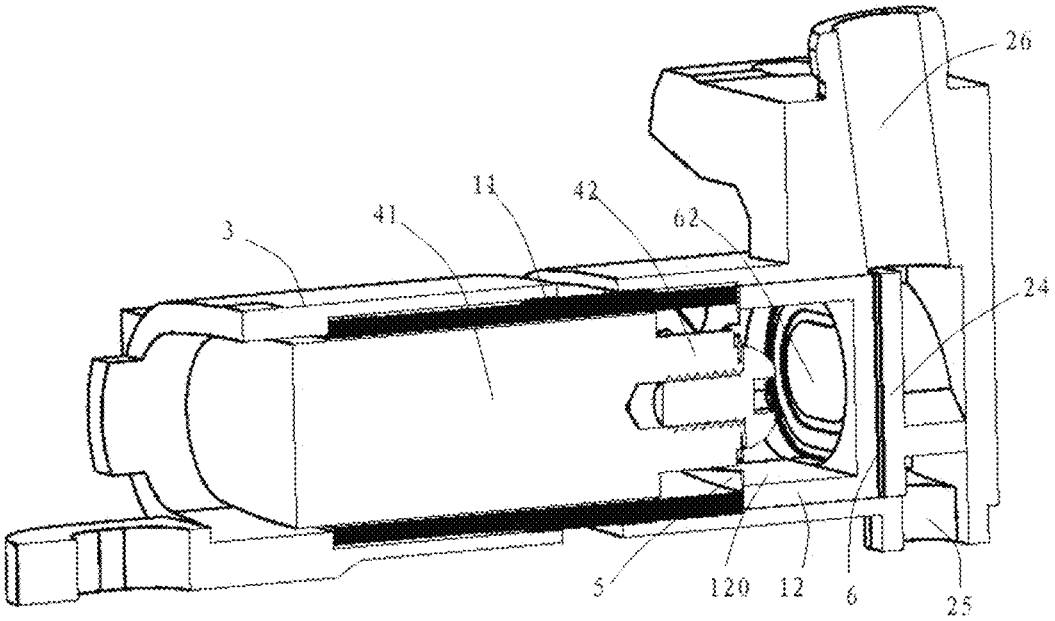
FIG. 4 is a schematic diagram of a first internal structure of the oil supply device for a compressor disclosed in the embodiment of the present application.
Figure 5:
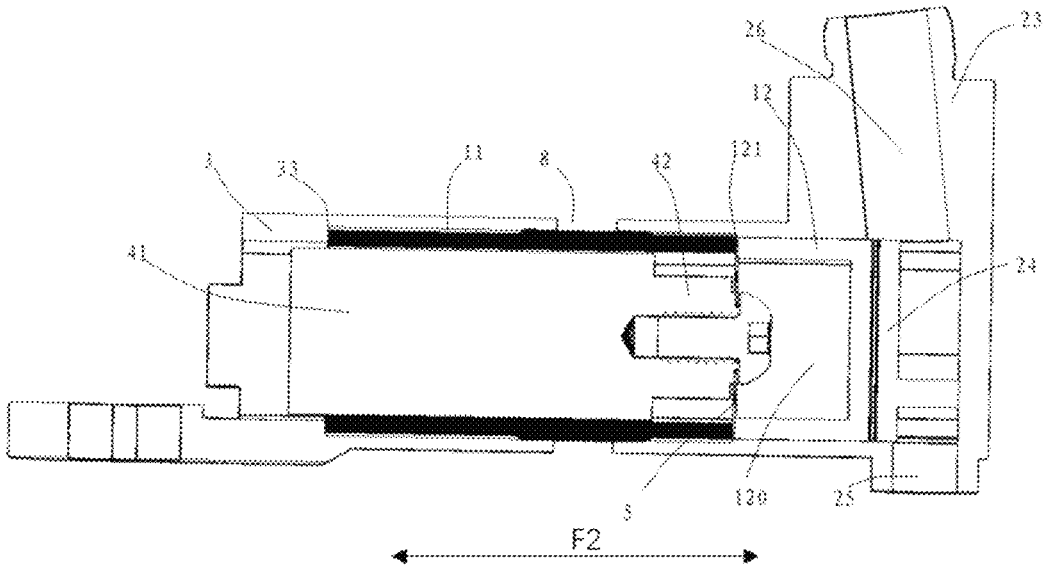
FIG. 5 is a schematic diagram of a second internal structure of the oil supply device for a compressor disclosed in the embodiment of the present application.

As shown in FIGS. 4-5, the frame 51 is positioned on the piston cylinder 1, and the installation part 53 extends into the inner chamber C. In this embodiment, the flat plate shrapnel 5 is arranged between the piston 4 and the bottom of the oil passage groove 120 of the cylinder cover 12. The frame 51 is clamped and positioned between the cylinder cover 12 and the cylinder body 11.

Setting the sliding elastic member as a plate-shaped flat plate shrapnel 5 can effectively reduce the space occupied by the sliding elastic member in the sliding direction F2 of the piston 4, facilitating an increase in the horizontal direction sliding stroke of the piston 4. At the same time, arranging the flat plate shrapnel 5 between the piston 4 and the cylinder cover 12 allows the flat plate shrapnel 5 to continuously receive maintenance from the lubricating oil entering the oil storage space, preventing rusting problems that could occur if the flat plate shrapnel 5 were exposed.

In another embodiment, the flat plate shrapnel 5 can also be arranged on the side of the piston 4 that faces away from the cylinder cover 12.

During actual use, as shown in FIG. 10, the piston 4 drives the installation part 53 to move during the sliding process. As the installation part 53 moves, it drives the elastic piece 52 to produce elastic deformation. One end of the elastic piece 52 is fixed to the frame 51, while the frame 51 is fixed to the piston cylinder 1, therefore, the elastic piece 52 bends elastically under the movement of the piston 4, resulting the fixed installation part 53 at the end of the elastic piece 52 away from the frame 51 can move with the piston 4 within a certain range. In this way, the kinetic energy of the piston 4 during sliding is converted into the elastic potential energy of the elastic piece 52, and when the motion of the piston 4 stops, the stored elastic potential energy provides an opposite force to drive the piston 4 to move again.

As shown in FIGS. 11 and 4-5, to facilitate the mounting and fixing of the installation part 53, the piston 4 has a piston body 41 and a fixing post 42 that extends from the piston body 41 towards the flat plate shrapnel 5, and the fixing post 42 is fixedly connected to the installation part 53. The fixing post 42 is integrally formed with the piston body 41 and extends outward from the side of the piston body 41 near the flat plate shrapnel 5.

As a preferred embodiment, as shown in FIG. 5, the shape of the fixing post 42 matches the installation part 53, and the maximum distance the fixing post 42 extends towards the flat plate shrapnel 5 is not less than the maximum travel distance of the piston 4. This configuration can avoid the piston body 41 from contacting the frame 51 during movement, avoid the piston body 41 from impacting the frame 51, thus makes the installation and fixing of the frame 51 more stable.

In this embodiment, the flat plate shrapnel 5 is arranged between the piston 4 and the piston cylinder oil inlet 13, and the distance between the frame 51 of the flat plate shrapnel 5 and the bottom wall of the piston cylinder 1 is not greater than the distance between the flat plate shrapnel 5 and the piston body 41. That is the distance between the frame 51 and the bottom of the oil passage groove 120 is not greater than the distance between the flat plate shrapnel 5 and the piston body 41. Additionally, as shown in FIG. 12, the bottom wall of the piston cylinder 1 is formed with a bottom wall limiting part 15 for abutting against the piston 4 to limit the position of the piston 4.

The bottom wall limiting part 15 is used to limit the axial travel of the piston 4, avoiding damage to the flat plate shrapnel 5 caused by excessive movement of the piston 4. The above structure is set up so that the bottom wall limiting part 15 abuts against and limits the piston 4 first, and the bottom wall limiting part 15 serves as the main limiter so that the restriction of the position of the piston 4 is accomplished before the piston body 41 and the frame 51 are abutted against, thereby prevents the piston body 41 from impacting the frame 51.

In a specific embodiment, as shown in FIG. 10, the flat plate shrapnel 5 is fixed to the fixing post 42 by a bolt, and the bottom wall limiting part 15 is used for abutting against the bolt on the fixing post 42 to realize the limitation of the position of the piston 4 in the axial direction.

As shown in FIG. 5, in this embodiment, the frame 51 is positioned between the cylinder body 11 and the cylinder cover 12, and the installation part 53 is set at the center of the opening of the oil passage groove 120.

The size of the opening of the oil passage groove 120 is smaller than the cross-sectional size of the piston chamber 110, and the cross-sectional size of the piston chamber 110 matches the cross-sectional size of the piston body 41. Therefore, as shown in FIG. 5, the size of the opening of the oil passage groove 120 is smaller than the cross-sectional size of the piston body 41. The portion of the cylinder cover 12 located at the edge of the oil passage groove 120 aligns with the position of the piston chamber 110 and forms the piston body limiting part 121, while the piston body limiting part 121 also aligns with the position of the piston body 41.

The piston body limiting part 121 is a part of the side wall of the cylinder cover 12, and this part exposed to the piston chamber 110 for abutting against the piston body 41 to limit the movement stroke of the piston 4. Part of the frame 51 can directly abut against the piston body limiting part 121, also preventing the piston body 41 from impacting the frame 51 during the sliding process of the piston 4, and thereby effectively protecting the stability of the frame 51's installation.

It should be noted that the size of the fixing post 42 is designed to match the installation part 53, ensuring that the fixing post 42 and the elastic piece 52 are misaligned with each other, so as to effectively preventing the fixing post 42 from abutting against the elastic piece 52 during movement. If the fixing post 42 abuts against the elastic piece 52 during sliding, it would limit the elastic deformation of the elastic piece 52, thereby restricting the movement stroke of the piston 4.

Further, the piston 4 also has a counterweight 43 beside the fixing post 42, and the counterweight 43 is misaligned with the elastic piece 52. Since the fixing post 42 needs to match the shape of the installation part 53, the size of the fixing post 42 cannot be too large, and in existing technology, the fixing post 42 is generally set into a cylindrical shape. The smaller size of the fixing post 42 correspondingly has a lower weight. However, to maintain the overall weight of the piston 4 within a certain range, it is generally necessary to increase the length of the piston 4 in the axial direction, which inevitably result in the entire device excessively large in the axial direction of the piston 4, which will have a certain limiting effect on the movement stroke of the piston 4.

Further, as shown in FIG. 11, in this embodiment, a counterweight 43 is also arranged beside the fixing post 42, and the counterweight 43 is misaligned with the elastic piece 52, which increases the weight of the piston 4 without affecting the sliding of the piston 4, thereby increasing the inertia of the piston 4, facilitating the sliding of the piston 4.

Of course, it can also be understood that due to the setting of the counterweight 43, a small section of the piston 4 originally arranged in the axial direction can be transferred to the counterweight 43, in this way, under the overall weight of the piston 4 remains unchanged, the length of the piston 4 in the axial direction can be reduced, thereby effectively decreasing the size of the oil supply device for a compressor, which is beneficial for the integrated design of the oil supply device for a compressor and can provide space for increasing the sliding stroke of the piston 4.

As shown in FIGS. 10 and 17, in this embodiment, a yielding space 54 is formed on the flat spring 5 opposite the position of the counterweight 43, and the elastic piece 52 extends outside the yielding space 54. The yielding space 54 can be a yielding hole set on the flat spring 5. As a preferred embodiment, in this embodiment, the yielding space 54 is formed by winding the elastic piece 52 in a curvilinear manner, and the yielding space 54 is the space enclosed between the elastic piece 52 and the installation part 53.

In this embodiment, the counterweight 43 is integrally formed with the fixing post 42 and extends outward from the fixing post 42; Both two opposite sides of the fixing post 42 are provided with the counterweight 43. The two counterweights 43 are arranged on the two opposite sides of the fixing post 42 along the long axis direction of the piston 4. This structural arrangement allows the piston 4 to be more stable during the sliding process.

In this embodiment, the size of the counterweight 43 in the vertical direction F3 first increases and then decreases as it extends away from the fixing post 42, and the counterweight 43 overall forming a teardrop shape; that is, the width of the counterweight 43 in the vertical direction F3 is variable. Specifically, from both sides of the fixing post 42 in the lateral direction F1, the width of the fixing post 42 in the vertical direction F3 first increases and then decreases. Accordingly, the yielding space 54 is adapted to the shape of the counterweight 43.

In this embodiment, the installation part 53 is set at the center of the flat plate shrapnel 5. The elastic piece 52 is provided in two curved extensions, and the two elastic pieces 52 are centrally symmetric with respect to the installation part 53. The two elastic pieces 52 can enhance the elastic potential energy accumulated during the deformation process of the elastic piece 52, so as to better realize the control of the sliding of the piston 4, and at the same time the setting of the two elastic pieces 52 can also effectively prevent excessive deformation of the elastic piece 52 caused by the excessive sliding of the piston, thereby preventing irreversible bending.

Both two elastic pieces 52 extend in curves and form two yielding spaces 54 by winding around, the two yielding spaces 54 correspond to the two counterweights 43, respectively, and the shapes of the two yielding spaces 54 are also symmetrically arranged around the center of the flat plate shrapnel 5.

In this embodiment, the elastic piece 52 has a fixed end and a free end arranged oppositely. The fixed end is fixed on the frame 51 and is positioned relatively on the upper side of the installation part 53, while the free end is set near the bottom of the installation part 53. This structural arrangement makes the yielding space formed by winding the elastic piece 52 is an overall circular arc-shape, so that the formed yielding space 54 better matches the counterweight 43.

Figure 6:
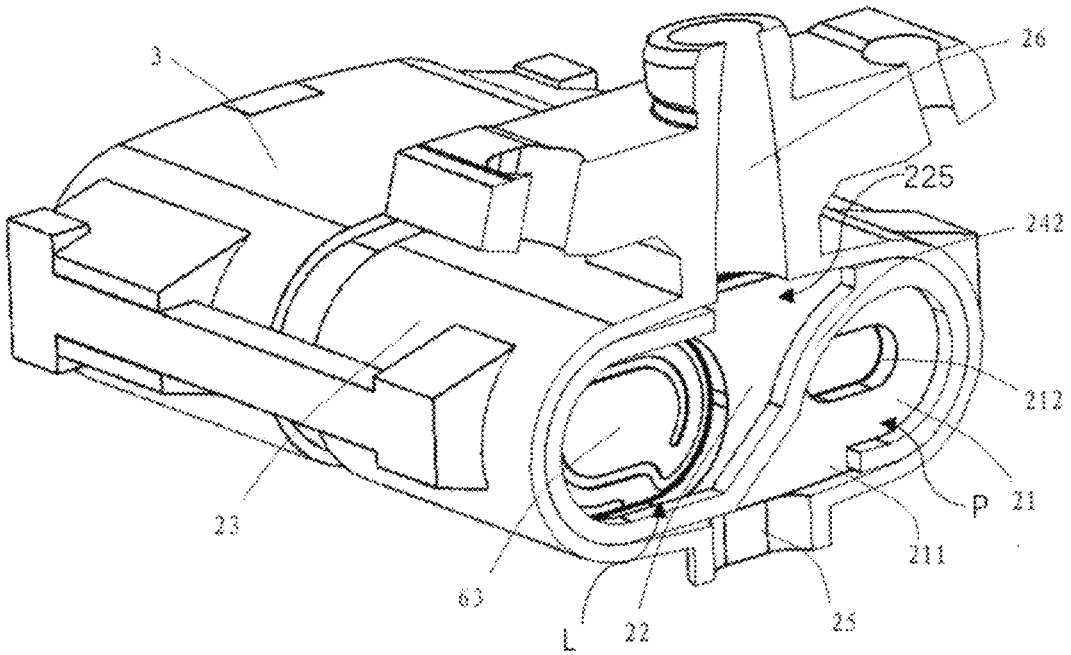
FIG. 6 is a schematic diagram of a third internal structure of the oil supply device for a compressor disclosed in the embodiment of the present application.
Figure 7:
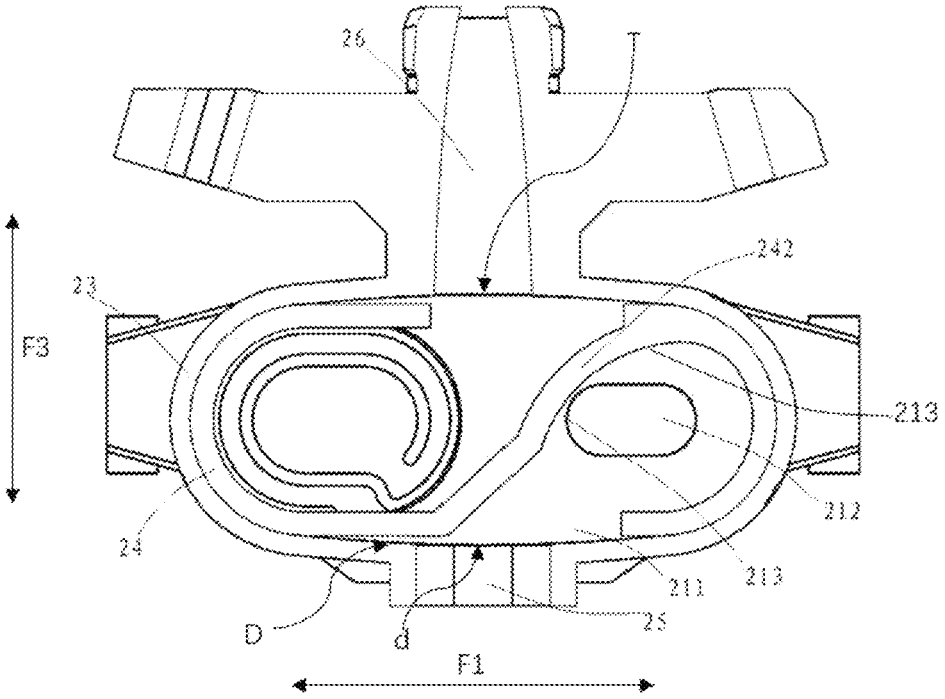
FIG. 7 is a schematic diagram of a fourth internal structure of the oil supply device for a compressor disclosed in the embodiment of the present application.

As shown in FIGS. 6-7, the oil intake passage P includes an oil intake chamber 21 provided on the outer housing 2 and extending horizontally, an oil inlet 211 provided on a side wall 214 of the oil intake chamber 21, and an oil outlet 212 provided on a bottom wall 215 of the oil intake chamber 21 and communicating with the inner chamber C;

The side wall 214 of the oil intake chamber 21 has an arcuate flow guide portion 213 for guiding the flow between the oil inlet 211 and the oil outlet 212.

In this embodiment, the oil intake chamber 21 extends horizontally and intakes oil from the side wall and then discharges oil from the bottom wall, the oil enters the oil intake chamber 21 through the oil inlet 211 located on the side wall, flows along the arcuate flow guide portion 213, and finally discharges out of the oil intake chamber 21 through the oil outlet 212 on the bottom wall. This configuration allows the oil entering from the oil inlet 211 to form a vortex at the oil outlet 212 after entering the oil intake chamber 21, and this vortex generation has a certain pressurizing effect to enable the oil in the oil intake chamber 21 to be discharged more quickly from the oil outlet 212, thereby improving the oil intake efficiency at the oil inlet 211.

In this embodiment, the oil inlet 211 is located at the bottom of the side wall 214 of the oil intake chamber 21, and the oil inlet 211 and the oil outlet 212 are misaligned with each other in a lateral direction F1. That is, the projection of the oil inlet 211 on the horizontal plane and the projection of the oil outlet 212 on the horizontal plane are misaligned with each other, and there is a certain distance between their projections in the lateral direction F1.

One end of the arcuate flow guide portion 213 extends to the oil inlet 211, and the other end of the arcuate flow guide portion 213 extends above the oil outlet 212, and the arcuate flow guide portion 213 bends in a direction away from the oil outlet 212. This configuration makes the bend of the curvature of the arcuate flow guide portion 213 more gentle, providing better flow guidance. As a preferred solution, the shape of the arcuate flow guide portion 213 conforms to an Archimedean spiral, and conforming to the Archimedean spiral can better form a vortex in the oil intake chamber 21.

Further, the opening direction of the oil outlet 212 is parallel to the sliding direction F2 of the piston 4, or the opening direction of the oil outlet 212 points to the sliding direction F2 of the piston 4, that is, the opening direction of the oil outlet 212 is parallel to the axial direction of the piston 4. Correspondingly, the extending direction of the oil intake chamber 21 is also parallel to the axial direction of the piston 4, this structural arrangement makes the oil circuit smoother, thereby improving the efficiency of oil entering and exiting the oil passage groove 120 and improving the oil supply efficiency of the oil supply device of a compressor.

The oil discharge passage L includes an oil discharge chamber 22 provided on the outer housing 2 and extending horizontally, an oil discharge inlet 221 provided on a bottom wall 224 of the oil discharge chamber 22, and an oil discharge outlet 222 provided on a side wall 223 of the oil discharge chamber 22, the oil discharge inlet 221 communicates with the inner chamber C.

To facilitate the communication with the inner chamber C, the oil discharge chamber 22 and the oil intake chamber 21 are arranged in parallel in the lateral direction F1, and the oil discharge outlet 222 is provided at the top 225 of the oil discharge chamber 22.

Figure 8:
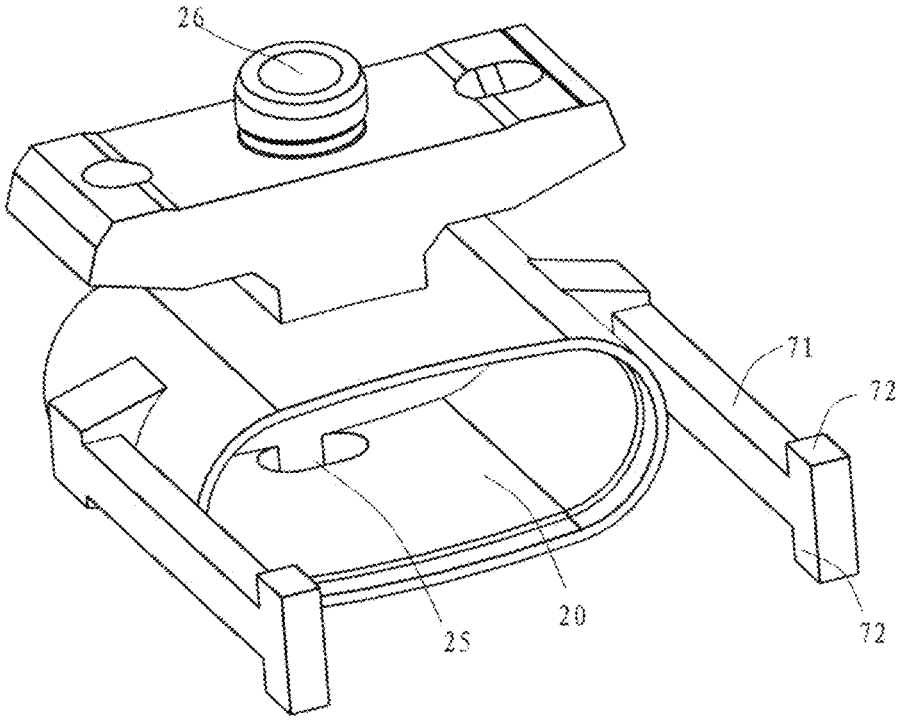
FIG. 8 is a schematic structural diagram of the housing body of the oil supply device for a compressor disclosed in the embodiment of the present application.
Figure 9:
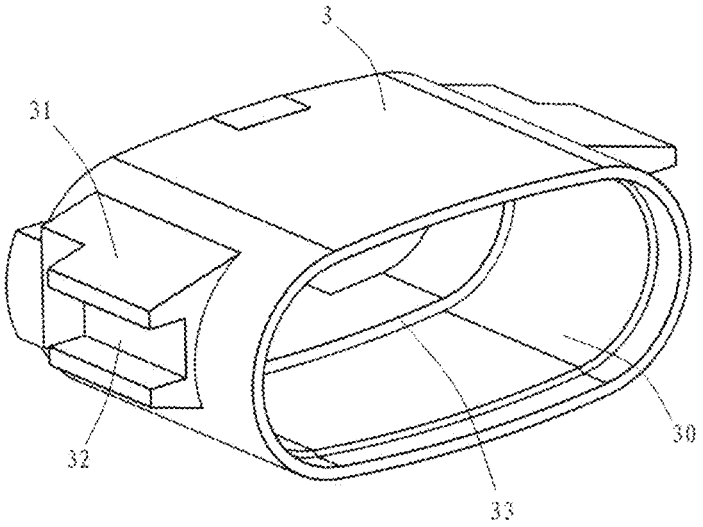
FIG. 9 is a schematic structural diagram of a housing base of the oil supply device for a compressor disclosed in the embodiment of the present application.
Figure 14:
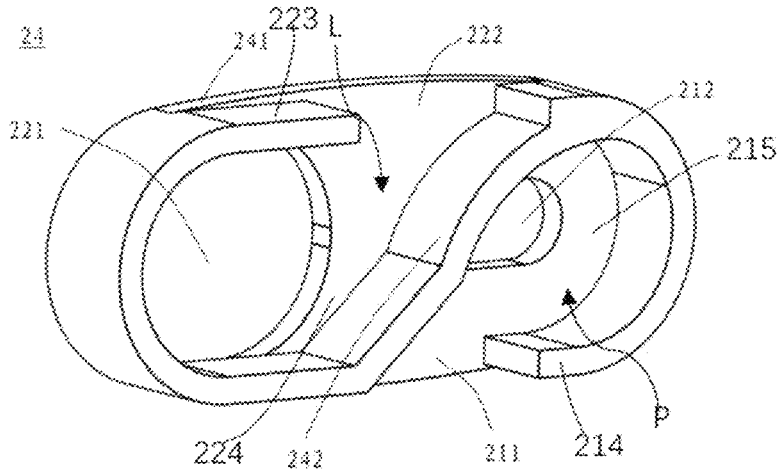
FIG. 14 is a first schematic structural diagram of a separator of the oil supply device for a compressor disclosed in the embodiment of the present application.
Figure 15:
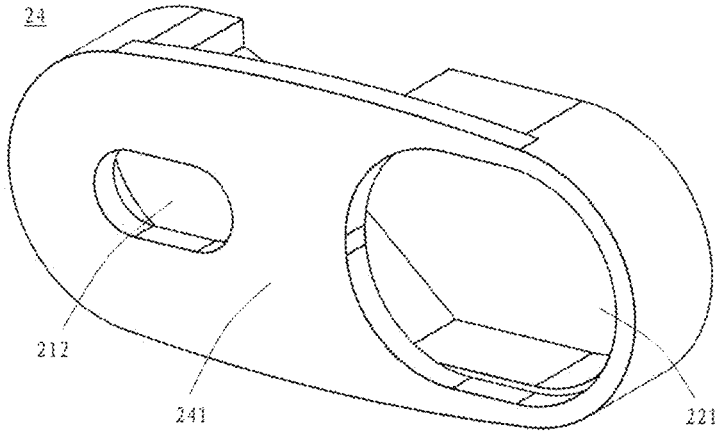
FIG. 15 is a second schematic structural diagram of the separator of the oil supply device for a compressor disclosed in the embodiment of the present application.

To facilitate the arrangement of the oil intake chamber 21 and the oil discharge chamber 22 on the outer housing 2, as shown in FIGS. 8, 14, and 15, the outer housing 2 includes a housing body 23 with a housing groove 20 and a separator 24 positioned within the housing groove 20, The separator 24 has a separation board 241 parallel to the bottom of the housing groove 20 and a partition plate 242 provided on the separation board 241. An oil chamber is formed between the separation board 241 and the bottom of the housing groove 20. The partition plate 242 is provided in the oil chamber and divides the oil chamber into the oil intake chamber 21 and the oil discharge chamber 22.

Setting the outer housing 2 as the separator 24 and the housing body 23 cooperating together, and the partition plate 242 is set up on the separator 24, the oil chamber within the housing groove 20 is divided into the oil intake chamber 21 and the oil discharge chamber 22 by the partition plate 242, facilitates the arrangement of the oil intake chamber 21 and the oil discharge chamber 22 on the outer housing 2. The separator 24 is designed to be detachable from the housing body 23, which also facilitates the processing, manufacturing, and installation of the separator 24.

At the same time, in this embodiment, the separator 24 and the housing body 23 are both made of plastic. Using plastic material facilitates the processing and manufacturing of components, especially for the design of some irregular structures, which can be conveniently achieved through injection molding.

To facilitate the installation and positioning of the separator 24 within the housing groove 20, the opening direction of the housing groove 20 faces the axial direction of the piston cylinder 1. As shown in FIG. 15, the oil outlet 212 and the oil discharge inlet 221 are arranged side by side on the separation board 241 in the lateral direction F1. The shape of the housing groove 20 matches the shape of the piston cylinder 1, and the housing groove 20 is sleeved outside the piston cylinder 1, with an interference fit between the piston cylinder 1 and the housing groove 20.

One end of the piston cylinder 1 extends into the housing groove and fixes the separator 24 against the bottom of the housing groove 20. Specifically, the cylinder cover 12 abuts against the piston cylinder 1, and the bottom wall of the cylinder cover 12 can directly abut against the separator 24, or there may be other components between them to transmit the abutting force through the components Once the outer housing 2 and the piston cylinder 1 are installed and fixed, the separator 24 is pressed against the bottom of the housing groove 20 by the pressing action of the cylinder cover 12.

The above embodiment provides a solution where the oil intake chamber 21 and the oil discharge chamber 22 are formed by separating the separator 24 and the housing body 23 with a housing groove 20. In another embodiment, the separator 24 can also be fixedly connected to the housing body 23, or the separator 24 and the housing body 23 can be integrally formed. Since the outer housing 2 is entirely made of plastic, integral injection molding can be easily achieved, naturally forming the oil intake chamber 21 and the oil discharge chamber 22 after molding.

As shown in FIGS. 5-7, the oil intake passage P also includes an oil intake hole 25 set on the housing body 23 and communicating with the oil intake chamber 21.

The oil discharge passage L also includes an oil discharge hole 26 set on the housing body 23 and communicating with the oil discharge chamber 22.

The oil intake hole 25 and the oil discharge hole 26 are respectively set on the side wall of the housing body 23, and the outlet of the oil discharge hole 26 is positioned opposite to the inlet of the oil intake hole 25, the outlet of the oil discharge hole 26 and the inlet of the oil intake hole 25 are respectively located on the top and bottom surfaces T,D of the outer housing 2.

Correspondingly, the oil inlet 211 of the oil intake chamber 21 is positioned opposite to the oil discharge outlet 222 of the oil discharge chamber 22 in the vertical direction F3. The oil inlet 211 is positioned opposite to the oil intake hole 25 and the oil inlet 211 communicates with the oil intake hole 25, the oil discharge outlet 222 is positioned opposite to the oil discharge hole 26 and the oil discharge outlet 222 communicates with the oil discharge hole 26.

In this embodiment, by arranging the oil intake chamber 21 and the oil discharge chamber 22 side by side in the lateral direction F1 and positioning the oil discharge hole 26 and the oil intake hole 25 opposite each other in the vertical direction F3, it facilitates the installation and fixation of the oil supply device of a compressor within the compression chamber. In the existing technology, the oil discharge hole 26 is generally connected and fixed to the compressor piston cylinder 200, while the oil intake hole 25 directly exposes to the compression chamber in the compressor housing 100, the lubricating oil is generally placed at the bottom of the compression chamber, and the oil intake hole 25 is used to draw oil directly from the bottom of the compression chamber.

In the existing technology, when the oil intake chamber 21 and the oil discharge chamber 22 are arranged side by side in the lateral direction F1, the oil intake hole 25 and the oil discharge hole 26, which are respectively connect with the oil intake chamber 21 and the oil discharge chamber 22, are generally set to be staggered with each other, this structural design is not convenient for realizing the installation design of the oil supply device of a compressor. In this embodiment, since the positions of the oil intake hole 25 and the oil discharge hole 26 are opposite, the position of the oil intake hole 25 can be determined based on the installation position of the oil discharge hole 26 on the compressor piston cylinder 200, thereby facilitating the design and installation of the oil supply device of a compressor 400.

To achieve the opposing positions of the oil discharge hole 26 and the oil intake hole 25, in the specific embodiment, the partition plate 242 is at least inclined relative to the horizontal plane. The arcuate flow guide portion 213 is arranged on the partition plate 242 on the side of the oil intake chamber 21.

Further, in the lateral direction F1, the inlet of the oil intake hole 25 is positioned at the center of the bottom surface of the outer housing 2. Since the shape of the outer housing 2 matches the shape of the piston cylinder 1, the piston cylinder 1 is also elliptical, when the inlet of the oil intake hole 25 is positioned at the center of the bottom surface of the outer housing 2, the inlet of the oil intake hole 25 is located exactly at the position of the lowest point of the outer housing 2. Since the bottom of the compression chamber is also curved, when the inlet of the oil intake hole 25 is located exactly at the position of the lowest point of the outer housing 2. It can make the oil supply device of a compressor to be installed at the center of the compression chamber, conveniently drawing the oil accumulated in the lowest area of the compression chamber.

The partition plate 242 has a partition portion located between the oil intake chamber 21 and the oil discharge chamber, a first enclosing plate 243 and a second enclosing plate 244 are set at both ends of the partition portion, the first enclosing plate 243 and the second enclosing plate 244 are integrally formed with the partition portion; The arcuate flow guide portion 213 is arranged on the partition portion on the side facing the oil intake chamber 21; the first enclosing plate 243 and the second enclosing plate 244 form an S-shape with the partition portion, and both the first enclosing plate 243 and the second enclosing plate 244 are abut against the bottom of the housing groove 20.

Both the first enclosing plate 243 and the second enclosing plate 244 are extended and arranged at an edge of the separation board 241, and the free end of the first enclosing plate 243 and the partition portion form the oil inlet 211, and the free end of the second enclosing plate 244 and the partition portion form the oil discharge outlet 222.

Figure 16:
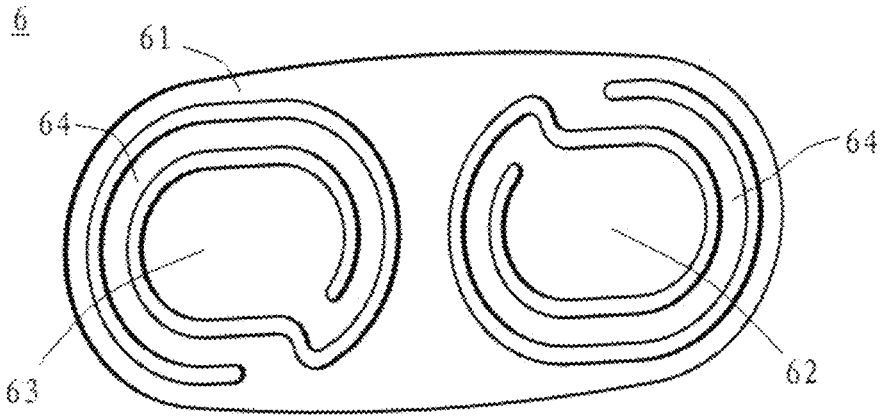
FIG. 16 is a schematic structural diagram of a oil valve of the oil supply device for a compressor disclosed in the embodiment of the present application.

As shown in FIG. 16, the oil supply device of a compressor also further comprising an oil valve 6 located between the piston cylinder 1 and the separation board 241, the oil valve 6 comprises a valve seat frame 61, an oil intake valve plate 62, and an oil discharge valve plate 63. Both the oil intake valve plate 62 and the oil discharge valve plate 63 are fixed to the valve seat frame 61 by their respective elastic connection plates 64. The valve seat frame 61 is clamped and fixed between the piston cylinder 1 and the separation board 241. It is understood that, as shown in FIG. 3, to prevent oil leakage, gaskets 9 are provided between the oil valve 6 and the piston cylinder 1, as well as between the oil valve 6 and the separation board 241.

The piston cylinder 1 has an oil intake avoidance space opposite to the oil intake valve plate 62, the separation board 241 has an oil intake limiting portion for abutting against the oil intake valve plate 62, the oil intake limiting portion is positioned at the edge of the oil outlet 212. In the initial state, the oil intake valve plate 62 blocks the oil outlet 212;

The piston cylinder 1 has an oil discharge limiting portion for abutting against the oil discharge valve plate 63, the oil discharge limiting portion is positioned at the edge of the piston cylinder oil outlet 14. The separation board 241 has an oil discharge avoidance space opposite to the oil discharge valve plate 63. In the initial state, the oil discharge valve plate 63 blocks the piston cylinder oil outlet 14.

When the piston 4 moves away from the cylinder cover 12, the oil intake valve plate 62 is moved towards the piston 4 by the suction force of the piston 4, and the end of the oil intake valve plate 62 away from the elastic connecting piece 64 opens, causing the elastic connecting piece 64 to elastically deform, the oil intake valve plate 62 bends towards the oil intake avoidance space, thereby opening the oil outlet 212. At this moment, the oil discharge valve plate 62 is pressed against the oil discharge limiting portion by the suction force of the piston 4, blocking the piston cylinder oil outlet 14. Thus, only oil intake can be realized without oil discharge, the oil enters into the oil passage groove 120 through the oil intake passage P.

When the piston 4 moves towards the cylinder cover 12, the end of the oil discharge valve plate 63 away from the elastic connecting piece 64 is pushed by the piston 4 and moves away from the piston 4. The oil discharge valve plate 63 bends towards the oil discharge avoidance space, thereby opening the piston cylinder oil outlet 14. At this moment, the oil intake valve plate 62 is blocked and limited by the oil intake limiting portion, thereby the oil intake valve plate 62 closes the oil outlet 212, in this process, only oil discharge is realized without oil intake.

As shown in FIGS. 12-15, in this embodiment, the size of the piston cylinder oil inlet 13 is larger than that of the oil intake valve plate 62, the piston cylinder oil inlet 13 forming the oil intake avoidance space;

The size of the oil discharge inlet 221 is larger than that of the oil discharge valve plate 63, the oil discharge inlet 221 forming the oil discharge avoidance space.

The size of the oil inlet 211 is smaller than that of the oil intake valve plate 62, the oil intake limiting portion is arranged on the separation board and located at the edge of the oil inlet 211.

The size of the piston cylinder oil outlet 14 is smaller than that of the oil discharge valve plate 63, with the oil discharge limiting portion is arranged on the piston cylinder 1 and located at the edge of the piston cylinder oil outlet 14.

The elastic connection pieces 64 include a first elastic connection piece and a second elastic connection piece. The oil intake valve plate 62 is fixed to the valve seat frame 61 by the first elastic connection piece, the first elastic connection piece is fixed near the upper part of the oil intake valve plate 62.

The oil discharge valve plate 63 is fixed to the valve seat frame 61 by the second elastic connection piece, the second elastic connection piece is fixed near the lower part of the oil discharge valve plate 63. The oil intake valve plate 62 and the oil discharge valve plate 63 are arranged symmetrically around the center.

In the above embodiment, the outer housing 2 is sleeved on the outside of the piston cylinder 1. During the sliding process of the piston 4, it is easily cause the piston cylinder 1 and the outer housing 2 to become detached. Therefore, in order to better realize the mounting and fixing of the outer housing 2 on the piston cylinder 1, as shown in FIGS. 1-3 and FIG. 9, the housing is also provided with a housing base 3. The outer housing 2 and the housing base 3 are arranged on the opposite sides of the piston cylinder 1 and are respectively sleeved on the outside of the piston cylinder 1.

A tensioning member 7 is provided between the housing base 3 and the outer housing 2 to prevent the housing base 3 and the outer housing 2 from moving apart.

One end of the tensioning member 7 is fixed on the outside of the outer housing 2, and the other end of the tensioning member 7 is detachably connected to the housing base 3.

The tensioning member 7 includes a connecting rod 71 fixed on the outer housing 2 and a limiting rod 72 extending laterally from the connecting rod 71;

The housing base 3 is provided with a positioning protrusion 31, and the limiting rod 72 abuts against the side wall of the positioning protrusion 31 away from the outer housing 2.

The positioning protrusion 31 is provided with a positioning slot 32 that matches the connecting rod 72, and the connecting rod 71 snaps into the positioning slot 32.

Both the housing base 3 and the outer housing 2 are interference-fitted with the cylinder body 11, and the outer housing 2 is sleeved over the cylinder cover 12, pressing and fixing the cylinder cover 12 onto the cylinder body 11.

The housing base 3 is provided with a base groove 30 that matches the piston cylinder 1, one end of the piston cylinder 1 is positioned within the base groove 30. The base groove 30 is equipped with an axial limiting part 33 that abuts against the piston cylinder 1 to limit the piston cylinder 1. The axial limiting part 33 is used to abut against the piston cylinder 1 to limit axial saving of the piston cylinder 1 within the base groove 30.

There is a gap part 8 between the housing base 3 and the outer housing 2, part of the cylinder body 11 exposed outwardly through the gap part 8. This gap part facilitates the dissipation of heat from the metal cylinder body 11, thereby reducing the wear of the piston 4.

Since both sides of the cylinder body 11 are enclosed by the housing base 3 and the outer housing 2, the heat dissipation performance is relatively poor, and setting the gap part between the housing base 3 and the outer housing 2 not only facilitates heat dissipation from the cylinder body 11 but also makes the assembly or disassembly of the oil supply device of a compressor more convenient.

The materials of the housing base 3 and the outer housing 2 can be plastic, so as to realize the processing and manufacturing conveniently.

Another embodiment of the present application also discloses a compressor, which includes a compressor housing with a compression chamber, a core assembly located in the compression chamber, and the aforementioned oil supply device of a compressor. The core assembly is fixed to the compressor housing by an elastic support part. The oil supply device for a compressor is fixed to the core assembly, the core assembly being provided with a compressor piston cylinder and a driving piston that movable in the compressor piston cylinder. The oil discharge passage L communicates with the compressor piston cylinder, and the oil intake passage P communicates with the compression chamber.

Figure 19:
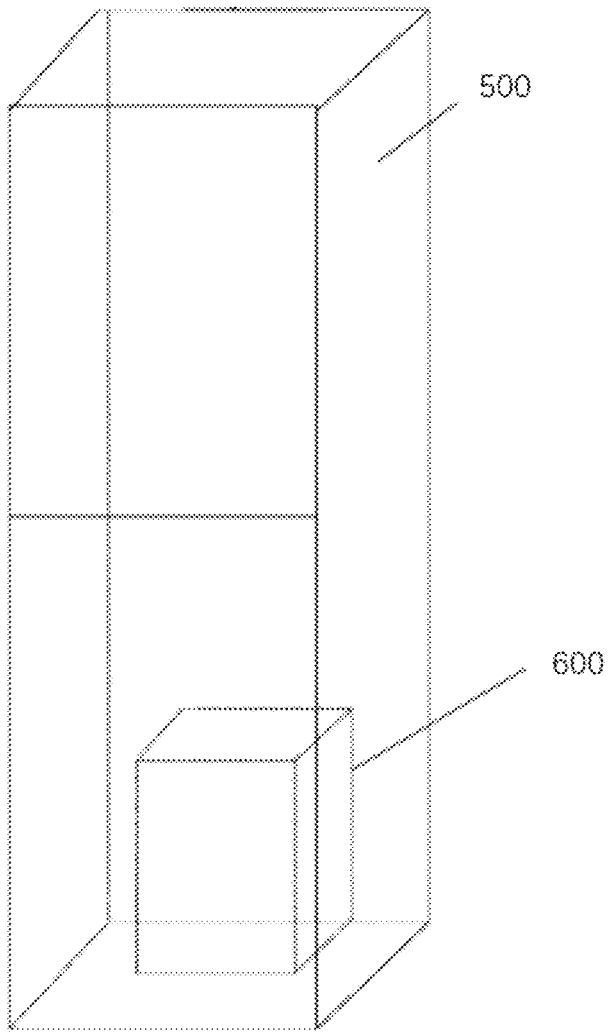
FIG. 19 is a schematic structural diagram of a refrigeration equipment of the present application.

As shown in FIGS. 19, Another embodiment of the present application also discloses refrigeration equipment 500, which includes a cabinet and a refrigeration system 600 installed on the cabinet. The refrigeration system 600 includes the aforementioned compressor.

The detailed description above, based on the illustrated embodiments, explains the structure, features, and effects of the present invention. The described embodiments are merely preferred examples of the present invention and are not intended to limit its scope. Any modifications or equivalent implementations made according to the concept of the present invention, without departing from the spirit covered by the specification and illustrations, should be within the protection scope of the present invention.

What is claimed is:

1. An oil supply device for a compressor, comprising: a piston cylinder with an inner chamber, a piston slidingly disposed in the inner chamber, an outer housing cooperating with the piston cylinder, the outer housing has a housing groove, one end of the piston cylinder extends into the housing groove, and an oil intake passage and an oil discharge passage provided on the outer housing;

the oil intake passage comprises an oil intake chamber extending horizontally, a bottom wall of the oil intake chamber arranged adjacent to the piston cylinder and a side wall of the oil intake chamber connected to the periphery of the bottom wall and extending horizontally away from the piston cylinder, an oil inlet set on the side wall of the oil intake chamber, and an oil outlet set on the bottom wall of the oil intake chamber that communicates with the inner chamber; the extending direction of the oil intake chamber is a horizontal direction and parallel to a sliding direction of the piston;

the side wall of the oil intake chamber has an arcuate flow guide portion to direct flow between the oil inlet and the oil outlet.

2. The oil supply device for the compressor according to claim 1, wherein the oil inlet is located at a bottom of the side wall of the oil intake chamber, and the oil inlet and the oil outlet are misaligned with each other in a lateral direction, the lateral direction is the horizontal direction and perpendicular to the sliding direction of the piston, there is a certain distance between the projection of the oil inlet and the projection of the oil outlet in the lateral direction.

3. The oil supply device for the compressor according to claim 2, wherein one end of the arcuate flow guide portion extends to the oil inlet, the other end of the arcuate flow guide portion extends above the oil outlet, and the arcuate flow guide portion curved in a direction away from the oil outlet;

and the shape of the arcuate flow guide portion conforms to an Archimedean spiral, the radius of the arcuate flow guide portion is proportional to the rotation angle.

4. The oil supply device for the compressor according to claim 1, wherein an opening direction of the oil outlet is parallel to the sliding direction of the piston.

5. The oil supply device for the compressor according to claim 1, wherein the oil discharge passage comprises an oil discharge chamber which is arranged parallel to the oil intake chamber in a lateral direction, a bottom wall of the oil discharge chamber arranged adjacent to the piston cylinder and a side wall of the oil discharge chamber connected to the periphery of the bottom wall and extending horizontally away from the piston cylinder, an oil discharge outlet on the side wall of the oil discharge chamber and an oil discharge inlet on the bottom wall of the oil discharge chamber; the lateral direction is the horizontal direction and perpendicular to the sliding direction of the piston;

the oil discharge inlet communicates with the inner chamber, and the oil discharge outlet is located at a top of the oil discharge chamber by a vertical direction, the vertical direction is perpendicular to the lateral direction and the sliding direction of the piston.

6. The oil supply device for the compressor according to claim 5, wherein the oil discharge outlet is positioned opposite to the oil inlet in the vertical direction;

the outer housing also has an oil discharge hole communicating with the oil discharge outlet and an oil intake hole communicating with the oil inlet, the outlet of the oil discharge hole is positioned opposite to the inlet of the oil intake hole, the outlet of the oil discharge hole and the inlet of the oil intake hole are respectively located on the top and bottom surfaces of the outer housing, the top and bottom surfaces of the outer housing are arranged along the vertical direction;

and the inlet of the oil intake hole is located at a lowest point of the bottom surface of the outer housing.

7. The oil supply device for the compressor according to claim 5, wherein the oil discharge chamber and the oil intake chamber are separated by a partition plate, the arcuate flow guide portion located at a side of the partition plate facing the oil intake chamber.

8. The oil supply device for the compressor according to claim 7, wherein the outer housing comprises a housing body with a housing groove and a separation board located in the housing groove and parallel to the bottom of the housing groove;

and the separation board separates the housing groove into an oil chamber and an external chamber, the partition plate is disposed in the oil chamber and separates the oil chamber into the oil discharge chamber and the oil intake chamber;

and wherein the oil discharge inlet and the oil outlet are arranged side by side on the separation board.

9. The oil supply device for the compressor according to claim 8, wherein the partition plate is fixed to the separation board and forms a separator with the separation board, the separator is positioned in the housing groove, and the partition plate is abut against the bottom plate of the housing groove.

10. The oil supply device for the compressor according to claim 9, wherein the partition plate has a partition portion located between the oil intake chamber and the oil discharge chamber, a first enclosing plate and a second enclosing plate are set at both ends of the partition portion, the first enclosing plate and the second enclosing plate are integrally formed with the partition portion;

and wherein the first enclosing plate and the second enclosing plate form an S-shape with the partition portion, and both the first enclosing plate and the second enclosing plate abut against the bottom of the housing groove;

and both the first enclosing plate and the second enclosing plate are extended and arranged at an edge of the separation board, the free end of the first enclosing plate and the partition portion form the oil inlet, the free end of the second enclosing plate and the partition portion form the oil discharge outlet.

11. The oil supply device for the compressor according to claim 9, wherein the bottom wall of the piston cylinder has a piston cylinder oil inlet and a piston cylinder oil outlet, the piston cylinder oil inlet is positioned opposite to the oil outlet, and the piston cylinder oil outlet is positioned opposite to the oil discharge inlet;

and the partition plate is located in the housing groove, the end of the piston cylinder extends into the housing groove fixes the separator against the bottom of the housing groove.

12. The oil supply device for the compressor according to claim 11, wherein the oil supply device for a compressor further comprising an oil valve located between the piston cylinder and the separation board, the oil valve comprises a valve seat frame, an oil intake valve plate and an oil discharge valve plate, the oil intake valve plate and the oil discharge valve plate are fixed to the valve seat frame by elastic connection plates;

and the piston cylinder has an oil intake avoidance space opposite to the oil intake valve plate, the separation board has an oil intake limiting portion for abutting against the oil intake valve plate, the oil intake valve plate blocks the oil outlet in the initial state;

and the piston cylinder has an oil discharge limiting portion for abutting against the oil discharge valve plate, the separation board has an oil discharge avoidance space opposite to the oil discharge valve plate, the oil discharge valve plate blocks the piston cylinder oil outlet in the initial state.

13. The oil supply device for the compressor according to claim 12, wherein the size of the piston cylinder oil inlet is larger than that of the oil intake valve plate, the piston cylinder oil inlet forming the oil intake avoidance space;

and the size of the oil discharge inlet is larger than that of the oil discharge valve plate, the oil discharge inlet forming the oil discharge avoidance space;

and the size of the oil inlet is smaller than that of the oil intake valve plate, the oil intake limiting portion is arranged on the separation board and located at the edge of the oil inlet;

and the size of the piston cylinder oil outlet is smaller than that of the oil discharge valve plate, with the oil discharge limiting portion is arranged on the piston cylinder and located at the edge of the piston cylinder oil outlet.

14. A compressor, comprising a compressor housing with a compression chamber, a core assembly located in the compression chamber, and the oil supply device for the compressor according to claim 1, the core assembly is fixed to the compressor housing by an elastic support part, the oil supply device for a compressor is fixed to the core assembly, the core assembly being provided with a compressor piston cylinder and a driving piston that movable in the compressor piston cylinder, the oil discharge passage communicates with the compressor piston cylinder, and the oil intake passage communicates with the compression chamber.

15. Refrigeration equipment, comprising a cabinet and a refrigeration system installed on the cabinet, wherein the refrigeration system comprises the compressor according to claim 14.

* * * * *